United States Patent [19]

Suzuki et al.

[11] Patent Number: 4,603,514

[45] Date of Patent: Aug. 5, 1986

[54] METHOD OF GRINDING A WORKPIECE HAVING A CYLINDRICAL PORTION AND SHOULDER PORTIONS

[75] Inventors: Ikuo Suzuki, Chiryu; Yukio Oda, Kariya, both of Japan

[73] Assignee: Toyoda Koki Kabushiki Kaisha, Kariya, Japan

[21] Appl. No.: 697,441

[22] Filed: Feb. 1, 1985

[30] Foreign Application Priority Data

Feb. 17, 1984 [JP] Japan ..... 59-27235

[51] Int. Cl.[4] ..... B24B 1/00; B24B 19/12

[52] U.S. Cl. ..... 51/281 C; 51/105 SP; 51/289 R; 51/326

[58] Field of Search ..... 51/105 SP, 289 R, 281 C, 51/326, 45, 48 R, 291, 165.77

[56] References Cited

U.S. PATENT DOCUMENTS

| | | | |
|---|---|---|---|
| 2,457,359 | 12/1948 | Floeter | 51/105 SP |
| 3,664,066 | 5/1972 | Clark | 51/289 R |
| 3,762,106 | 10/1973 | Yuryan | 51/105 SP |
| 4,115,958 | 9/1978 | Englander et al. | 51/289 R |
| 4,510,719 | 4/1985 | Yoneda et al. | 51/289 R |

FOREIGN PATENT DOCUMENTS 54-114891 9/1979 Japan .

*Primary Examiner*—Frederick R. Schmidt
*Assistant Examiner*—Bradley I. Vaught
*Attorney, Agent, or Firm*—Oblon, Fisher, Spivak, McClelland & Maier

[57] ABSTRACT

A method for grinding a work having a cylindrical portion and a couple of shoulder portions extending at right angles from the opposite ends of the cylindrical portion, the method comprising the steps of:

(a) rotating the work about the axis of the cylindrical portion;

(b) rotating a cylindrical grinding wheel with a width smaller than the space between the shoulder portions of the work about an axis parallel with the axis of the cylindrical portion;

(c) feeding the grinding wheel relative to the work along an oblique path inclined to one direction with respect to the rotational axis of the grinding wheel, thereby simultaneously grinding one of the shoulders and a contiguous cylindrical portion; and (d) feeding the grinding wheel relative to the work along an oblique parth inclined to the other direction with respect to the rotational axis of the grinding wheel, thereby simultaneously grinding the other one of the shoulders and the remainder of the cylindrical portion.

6 Claims, 7 Drawing Figures

METHOD OF GRINDING A WORKPIECE HAVING A CYLINDRICAL PORTION AND SHOULDER PORTIONS

BACKGROUND OF THE INVENTION

1. Field of the Invention:

This invention relates to a method of grinding a workpiece with a cylindrical portion and a couple of shoulder portions formed contiguously to the cylindrical portion through a curved portion, like crank shaft pins or journals.

2. Description of the Prior Art:

As shown in FIG. 1, a crank shaft pin or journal generally has a straight cylindrical portion CP and shoulder portions SP which are formed on opposite sides of and connected to the cylindrical portion CP through rounded corner portions RCP. For grinding such a pin or journal, it has been the conventional practice to employ a full-form grinding wheel g with a shape corresponding to that of a machining portion of a workpiece, forming the cylindrical and shoulder portions CP and SP by plunge grinding.

This grinding method requires to provide various full-shape grinding wheels g according to the kinds of crank shafts to be machined. Besides, the plunge grinding by a full-shape grinding wheel g involves a greater amount of grinding per unit grinding width S at the cylindrical and shoulder portions CP and SP, so that the rounded corner portions RCP which are formed at the opposite axial ends of the circumference of the full-shape grinding wheel g undergo considerable abrasive wear, as a result inviting deteriorations in grinding accuracy of the shape of the rounded corner portions adjacent the shoulder portions SP. In order to avoid this problem, tooling for re-shaping the rounded corner portions is necessitated although the circumferential surface of the full-shape grinding wheel g is still usable. However, in view of the recent trend of using expensive CBN (cubic boron nitride) grinding wheels for the purpose of enhancing the efficiency of grinding operation, it is extremely disadvantageous from the standpoint of machining cost to provide such grinding wheels in a large variety or to leave a large allowance for tooling.

SUMMARY OF THE INVENTION

It is an object of the present invention to provide a grinding method which can prevent concentration of load on rounded corner portions of a grinding wheel to avoid localized abrasive wear of the corner portions, uniformly subjecting a cylindrical circumferential surface and rounded corner portions of a grinding wheel to abrasive wear.

Briefly stated, for grinding a workpiece with a cylindrical portion and a couple of shoulder portions which are formed at opposite ends of the cylindrical portion through curved portions, the grinding method of the present invention employs a cylindrical grinding wheel which is provided with rounded corners at opposite ends and formed in a width smaller than the width of the space between the two shoulder portions. This grinding wheel is moved in a direction perpendicular to the axis of a workpiece while the latter is moved in the axial direction. The grinding wheel and workpiece are simultaneously moved relative to each other in two perpendicularly intersecting directions. One shoulder portion and part of the cylindrical portion are shaped by oblique feed grinding, followed by a similar grinding operation on the other shoulder portion and the remainder of the cylindrical portion.

The above and other objects, features and advantages of the invention will become apparent from the following description and appended claims, taken in conjunction with the accompanying drawings which show by way of example one preferred embodiment of the invention.

PARTICULAR DESCRIPTION OF THE INVENTION

Figure 2:
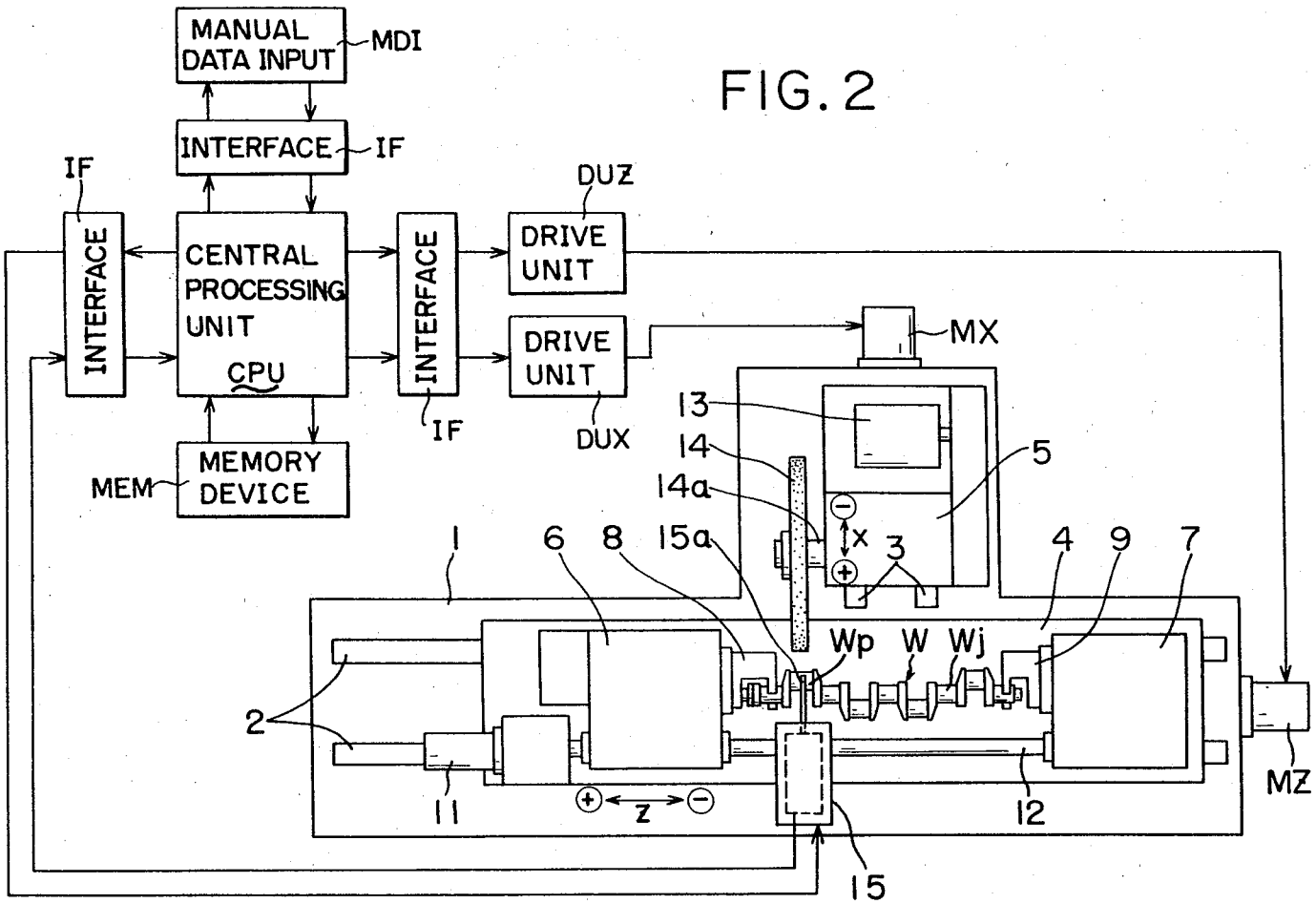
FIG. 2 is a diagrammatic illustration of a grinding machine for carrying out the method of the invention.

Referring to FIG. 2, there is shown a diagrammatic plan view of a grinding machine for carrying out the method of the invention. The machine includes a grinder bed 1 with guide surfaces 2 and 3 extending in perpendicularly intersecting directions, i.e., in the directions of Z- and X-axes, respectively. Mounted on the guide surfaces 2 of the Z-axis direction is a table 4 and on the guide surfaces 3 of the X-axis direction is a grinding head 5 for reciprocating movements thereon.

Provided on the opposite ends of the table 4 are left and right spindle supports 6 and 7, supporting therebetween a crank shaft W through chucks 8 and 9 such that the axis of the crank shaft W is disposed parallel with the Z-axis. Work spindles (not shown) which are supported in the spindle supports 6 and 7 are rotated by a drive motor 11 in synchronism with each other by a synchronizing shaft 12.

Further, a servo motor Mz is provided on a lateral side at one end of the bed 1 in the vicinity of the right spindle support 7 to move the table 4 in (+) and (−) directions of the Z-axis along the guide surfaces 2.

A grinding wheel drive motor 13 is mounted on the grinding head 5 to rotate a grinding wheel 14 which is fixedly mounted on a grinding spindle **14*a* projecting sideward from the grinding head 5 in parallel relation with the axis of the crank shaft W. Another servo motor Mx is fixedly mounted on a lateral side at the other end of the bed 1 in the vicinity of the grinding head 5 for moving same in (+) and (−) directions of the X-axis along the guide surfaces 3**.

Designated at 15 is a sizing device with a feeler **15*a* for detecting whether or not dimensions of a machining work, e.g., a pin Wp or a journal Wj of a crank shaft W reach a predetermined value. The output signal of the sizing device 15** is fed to a central processing unit CPU through an input/output interface IF. The central processing unit CPU is further connected to manual data input MDI, memory device MEM, and drive units DUZ and DUX which control the servo motors Mz and Mx, respectively.

Figure 4:
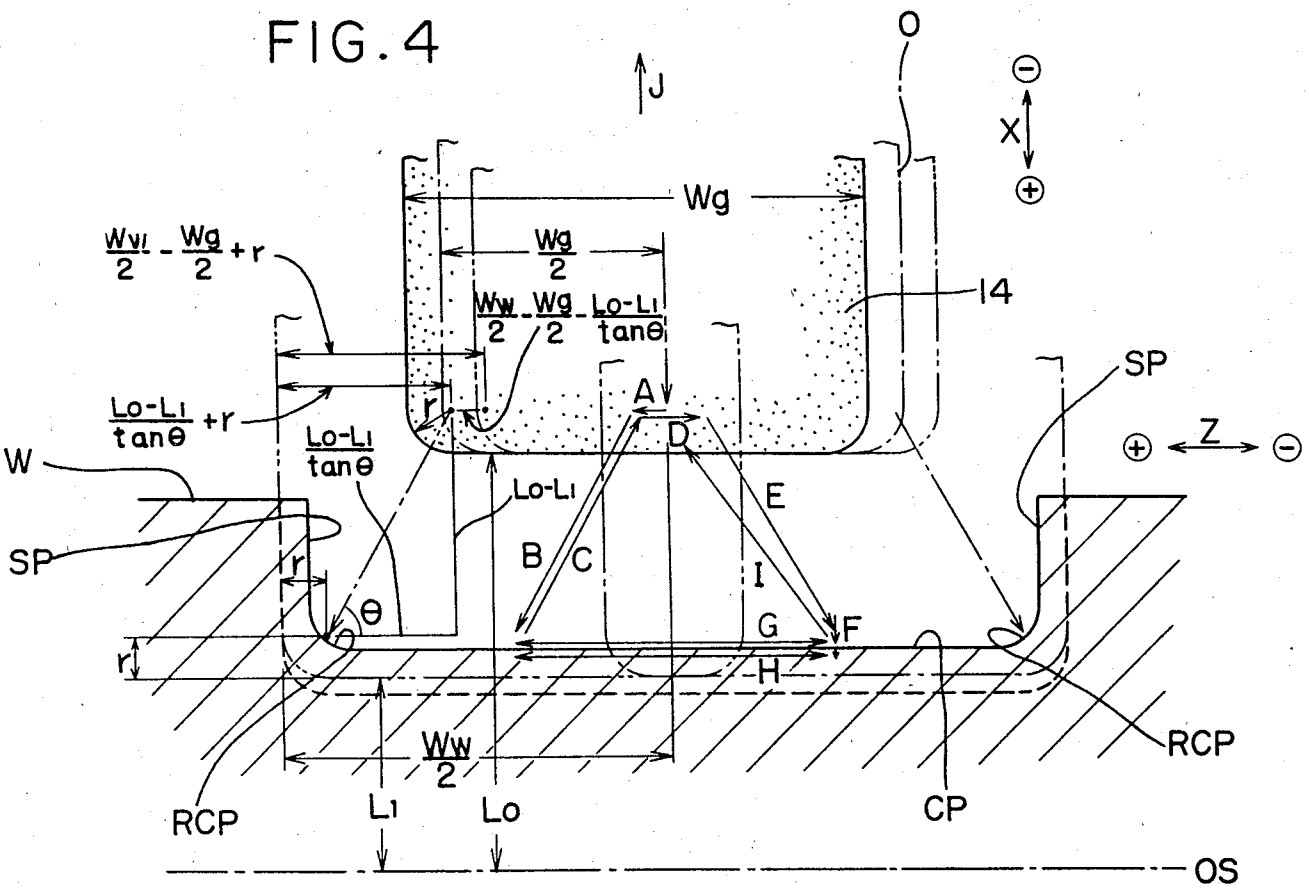
FIG. 4 is a diagrammatic illustration explanatory of the method of the invention.

As illustrated particularly in FIG. 4, a pin Wp or a journal Wj of the crank shaft W has a cylindrical portion CP and shoulder portions SP with rounded corner portions on the opposite sides of the cylindrical portion CP. These cylindrical and shoulder portions CP and SP are the work portions which need grinding.

Figure 7:
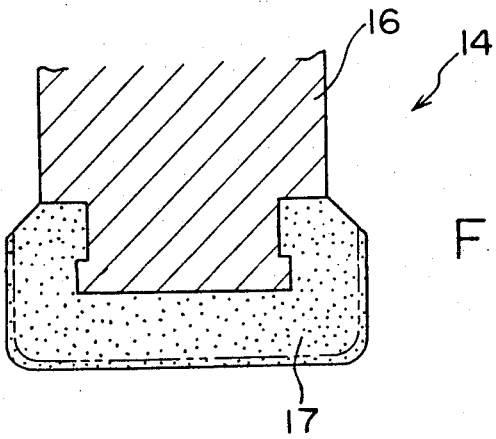
FIG. 7 is a diagrammatic view of a grinding wheel suitable for use in the present invention.

The grinding wheel 14 which is employed in the present invention is a cylindrical grinding wheel with a grinding width Wg smaller than the distance between the two shoulder portions SP of the work and provided with rounded corners at the opposite ends thereof. As shown in FIG. 7, the grinding wheel 14 is constituted by a circular base member 16 and a grain layer 17 which is formed around the circumference of the base member 16.

Figure 1:
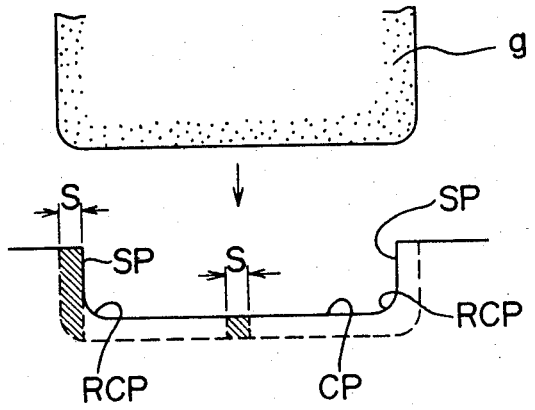
FIG. 1 PRIOR ART
FIG. 1 is a diagrammatic view employed for the explanation of a conventional grinding method.
Figure 3:
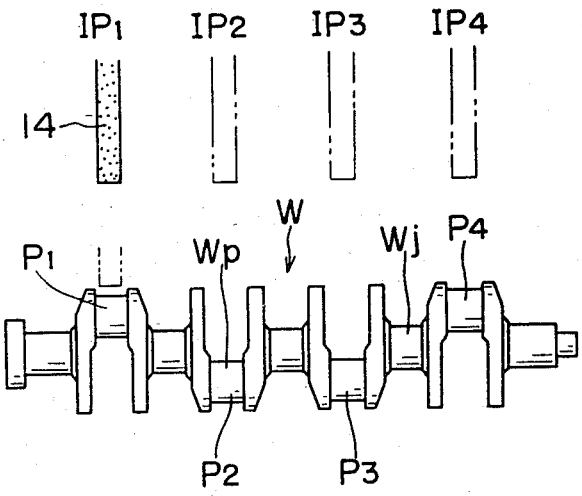
FIG. 3 is a diagrammatic view of a workpiece with a number of machining portions to be shaped by the method of the invention.
Figure 5:
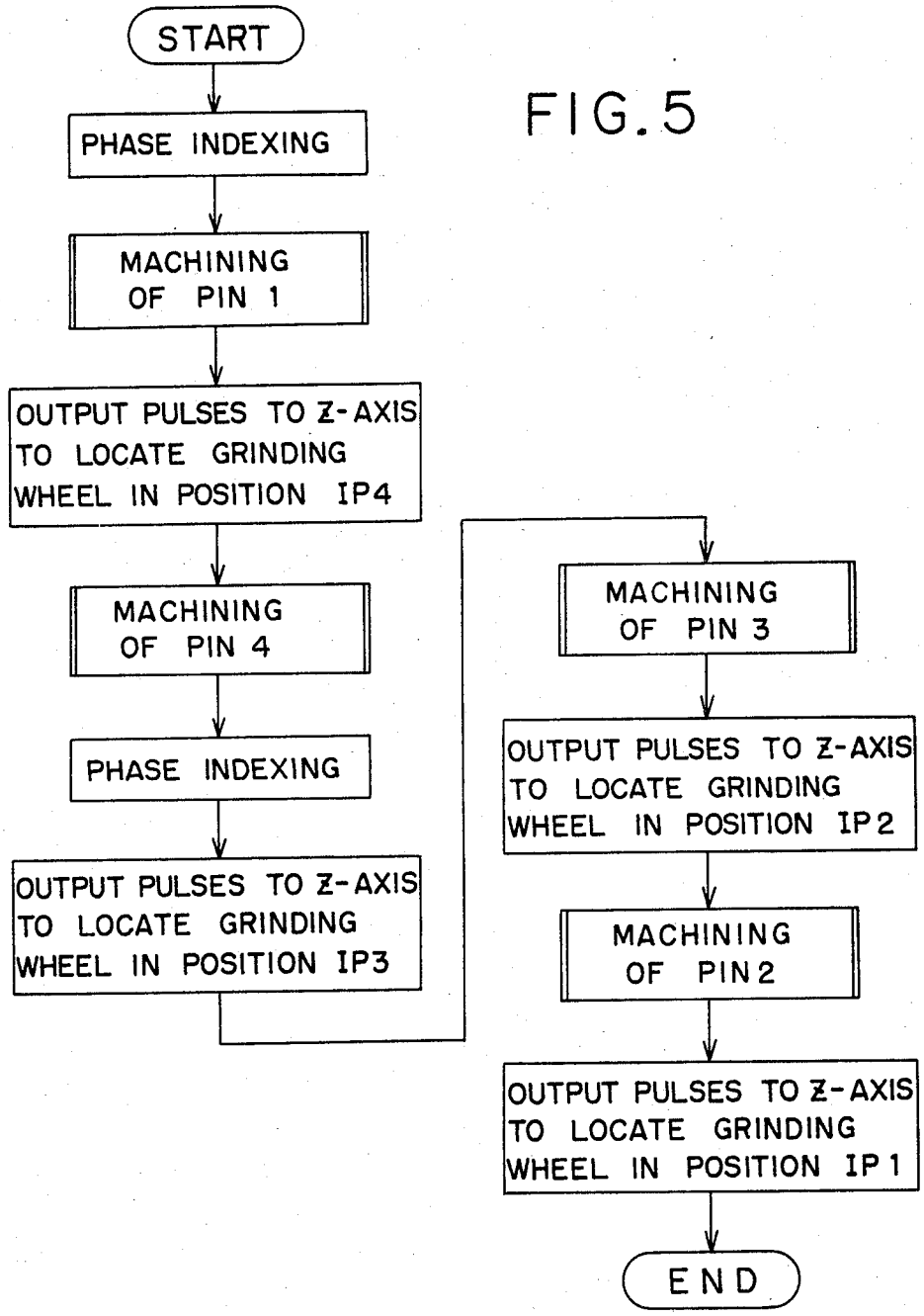
FIG. 5 is a block diagram showing the sequential steps of grinding operation.

The procedures for a grinding operation, for example, for grinding pins Wp of a 4-cylinder engine crank shaft as shown in FIGS. 2 and 3 are as follows. In this case, first and fourth pins $P_1$ and $P_4$ are in phase with each other, while second and third pins $P_2$ and $P_3$ are in phase with each other. Therefore, after aligning the first and fourth pins $P_1$ and $P_4$ with the center of the spindles by phase indexing, the first pin $P_1$ and the fourth pin $P_4$ are machined successively. In the next place, the third and second pins $P_3$ and $P_2$ are machined successively after aligning them with the center of spindles by phase indexing. The reference characters $IP_1$ and $IP_4$ indicate the index positions corresponding to the first to fourth pins $P_1$ to $P_4$, respectively. (See FIG. 5)

For grinding these work portions, the method of the present invention employs a disk-like grinding wheel 14 as stated hereinbefore, moving the grinding head 5 in the direction of the X-axis perpendicular to the axis of the crank shaft and at the same time moving the table 4 of the grinder in the direction of the Z-axis or the axis of the crank shaft to grind the work by oblique feed grinding, firstly one shoulder portion SP and an adjoining cylindrical portion CP and then the other shoulder portion SP and an adjoining cylindrical portion CP.

This grinding method is explained in greater detail with reference to FIGS. 4 and 6. Upon receipt of a start signal, positive pulses are fed to the X-axis until the grinding wheel 14 is located in an initial machining position 0 (Step 0 of FIG. 6). At the initial machining position 0 of the grinding wheel 14, the center Wg/2 of the width Wg of the grinding wheel 14 is in alignment with the center Ww/2 of the dimensions Ww between the two shoulder portions Sp in finished state, and the working surface of the grinding wheel 14 is spaced from the center OS of the crank shaft W by a distance Lo.

In order to grind the left shoulder portion SP in FIG. 4 and a contiguous cylindrical portion CP by the grinding wheel 14 which is located in the initial machining position 0, a number of negative pulses corresponding to $$\frac{Ww}{2} - \frac{Wg}{2} - \frac{L_0 - L_1}{\tan\theta}$$

are fed to the Z-axis (Step A of FIG. 6) to move the grinding wheel 14 to a position opposing the left-hand machining portion of the work. Nextly, a number of negative pulses corresponding to $$\frac{L_0 - L_1}{\tan\theta}$$

and a number of positive pulses corresponding to $L_0 - L_1$ are simultaneously fed to the Z- and X-axes, respectively. (Step B of FIG. 6) As a result, the grinding wheel 14 is fed obliquely as indicated by arrow B in FIG. 4 to perform oblique feed grinding.

Thereafter, a number of positive pulses corresponding to $$\frac{L_0 - L_1}{\tan\theta}$$

and a number of negative pulses corresponding to $L_0 - L_1$ are simultaneously fed to the Z- and X-axes, respectively, (Step C of FIG. 6) thereby moving the grinding wheel 14 obliquely into a retracted position away from the work as indicated by arrow C in FIG. 4.

Now, the operation proceeds grinding of the other or the right-hand shoulder portion SP of FIG. 4 and a contiguous cylindrical portion CP. Therefor, a number of positive pulses corresponding to $$Ww - Wg - 2\frac{L_0 - L_1}{\tan\theta}$$

is fed to the Z-axis (Step D of FIG. 6) to locate the grinding wheel 14 in a position opposing the right-hand machining portion of the work. Then, a number of positive pulses corresponding to $$\frac{L_0 - L_1}{\tan\theta}$$

and a number of positive pulses corresponding to $L_0 - L_1$ are fed to the Z- and X-axes, respectively. (Step E of FIG. 6) Consequently, the grinding wheel 14 is fed obliquely to effect oblique feed grinding as indicated by arrow E.

Figure 6:
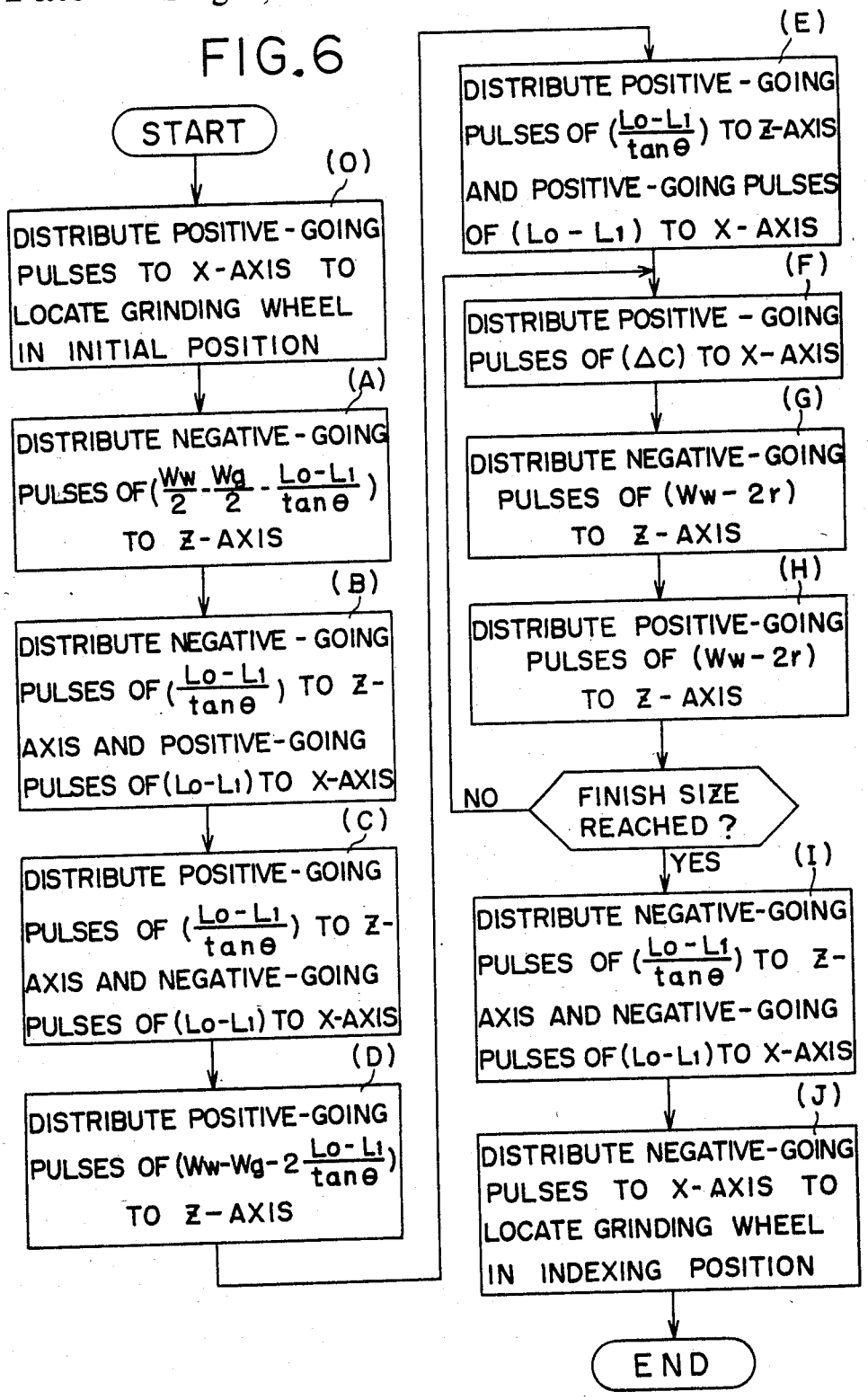
FIG. 6 is a block diagram showing the steps of the method of the present invention in relation with FIG. 4.

By the above-described oblique feed grinding operations in the directions of arrows B and E, the two shoulder portions SP and cylindrical portion CP can be machined into finish dimensions. In this instance, upon detection of the finish dimensions, a number of negative pulses corresponding to $$\frac{L_0 - L_1}{\tan\theta}$$

and a number of negative pulses corresponding to $L_0 - L_1$ are fed to the Z- and X-axes, respectively, to retract the grinding wheel 14 obliquely (Step I of FIG. 6). Thereafter, negative pulses are fed to the X-axis until the grinding wheel 14 is located in the indexing position. (Step J of FIG. 6).

In the particular embodiment shown, traverse grinding is effected subsequent to Step E thereby to grind the cylindrical portion CP of the work W into finish dimensions. Namely, in Step F which comes after Step E, a number of positive pulses corresponding to a depth of incision $\Delta C$ is fed to the X-axis to feed the grinding wheel 14 accordingly. After this, a number of negative pulses corresponding to $Ww - 2r$ are fed to the Z-axis (Step G of FIG. 6), and further a number of positive pulses corresponding to $Ww - 2r$ are fed to the Z-axis (Step H of FIG. 6). These Steps G and H may be repeated for a necessary number of times. Upon completion of Steps G and H, the grinding wheel is returned to the indexing position by the operations of Steps I and J.

As clear from the foregoing description, the method of the present invention permits to grind various kinds of works with a shape like a pin or journal of a crank shaft by the use of the same grinding wheel, on the basis of input data of finish dimensions.

Further, since one cylindrical grinding wheel is fed obliquely to grind one after another of the two shoulder portions and the contiguous cylindrical portions of a workpiece, it is possible to grind the shoulder and cylindrical portions at the same rate per unit width, and to preclude concentration of load at the rounded corners of the grinding wheel, preventing localized abrasion of the rounded corners. It follows that the rounded corners and cylindrical portions of the grinding wheel are subjected to abrasion uniformly, permitting a minimum allowance for tooling, which is a great economical advantage in view of the reduction of cost of the grinding wheel.

What is claimed is:

1. A method of grinding a workpiece having a cylindrical portion and a couple of shoulder portions extending at right angles from the opposite ends of said cylindrical portion, said method comprising the steps of:

(a) rotating said workpiece about the axis of said cylindrical portion;

(b) rotating a cylindrical grinding wheel with a width smaller than the space between said shoulder portions, about an axis parallel with the axis of said cylindrical portion;

(c) effecting relative movements between said grinding wheel and said workpiece along a first oblique path inclined to one direction with respect to the rotational axis of said cylindrical portion by simultaneously moving said grinding wheel and said workpiece respectively in radial and axial directions of said cylindrical portion, so as to simultaneously grind one of said shoulder portions and a part of said cylindrical portion; and (d) effecting relative movements between said grinding wheel and said workpiece along a second oblique path inclined to the other direction with respect to the rotational axis of said cylindrical portion by simultaneously moving said grinding wheel and said workpiece respectively in said radial and axial directions, so as to simultaneously grind the other of said shoulder portions and another part of said cylindrical portion.

2. A method as set forth in claim 1, further comprising between steps (c) and (d) a step (e) of moving said workpiece in the axial direction of said cylindrical portion.

3. A method as set forth in claim 2, further comprising subsequent to step (d), a step (f) of moving said grinding wheel in the radial direction of said cylindrical portion for giving said grinding wheel a predetermined finish infeed, and subequent to step (f), a step (g) of moving said workpiece in the axial direction of said cylindrical portion for effecting a finish grinding on said workpiece.

4. A method as set forth in claim 3, wherein said grinding wheel has an arc of a radius (r) at opposite ends of a circumferential surface thereof, and wherein said workpiece is moved in step (g) by a traverse feed amount (TF) expressed by the following equation $$TF = Ww - 2r$$

where Ww is the width of a space between said shoulder portions in a finished state and r is the radius of the arc at the opposite ends of said circumferential surface of said grinding wheel.

5. A method as set forth in claim 2, wherein said grinding wheel and said workpiece in each of steps (c) and (d) are moved in the radial and axial directions of said cylindrical portion by respective amounts (Ir) and (Ia) expressed by the following equations $$Ir = L0 - L1, \text{ and}$$

$$Ia = (L0 - L1)/\tan\theta$$

where L0 is the distance between the axis of said cylindrical portion and a circumferential surface of said grinding wheel being at a retracted position, L1 is a finished radius of said cylindrical portion, and $\theta$ is the angle of said oblique path with respect to the axis of said cylindrical portion.

6. A method as set forth in claim 5, wherein said workpiece in step (e) is moved in the axial direction of said cylindrical portion by an amount (Fs) expressed by the following equation $$Fs = Ww - Wg - 2\left(\frac{L0 - L1}{\tan\theta}\right)$$

where Ww is the width of a space between said shoulder portions in a finished state and Wg is the width of said grinding wheel.

* * * * *